United States Patent [19]

McMinn

[11] Patent Number: 4,627,166

[45] Date of Patent: Dec. 9, 1986

[54] WASHER CUTTER

[76] Inventor: William D. McMinn, 42215 52nd St. W., Quartz Hill, Calif. 93534

[21] Appl. No.: 593,671

[22] Filed: Mar. 26, 1984

[51] Int. Cl.[4] ..... B26B 7/00

[52] U.S. Cl. ..... 30/277; 10/22; 10/155 R; 29/426.4; 29/426.5; 72/478

[58] Field of Search ..... 30/277, 182, 168; 10/22, 155 R; 29/426.4, 426.5; 72/478

[56] References Cited

U.S. PATENT DOCUMENTS 405,191 6/1889 Urschel ..... 22/478 X 3,231,972 2/1966 Ammese et al. ..... 30/168

FOREIGN PATENT DOCUMENTS 536786 5/1941 United Kingdom ..... 30/168

*Primary Examiner*—Douglas D. Watts

*Attorney, Agent, or Firm*—Blakely, Sokoloff, Taylor & Zafman

[57] ABSTRACT

A device is provided which can be used to remove washers from bolts in an efficient, fast and safe manner. The device is comprised of a removable blade assembly disposed in a handle device. The blade assembly has an opening permitting the insertion of the bolt such that when the bolt is fully inserted into the blade assembly, the washer is in contact with a plurality of substantially radially disposed blades. The device itself is provided with a handle, in one embodiment knurled, so that it may be held in a persons hand. After the bolt is inserted into the device, the bolt head is tapped using a striking device, such as a hammer. The force of the impact causes the blades to be driven into the washer, splitting the washer into several arc-shaped pieces and separating them from the bolt. The resulting pieces fall away from the bolt when the bolt is removed from the device, or at least then may be very easily removed from the bolt.

8 Claims, 3 Drawing Figures

WASHER CUTTER

BACKGROUND OF THE INVENTION

1. Field of the Invention

This invention relates to washer removal devices and, in particular, to a hand held device for the removal of washers from bolts.

2. Description of the Prior Art

Washers are frequently used on bolts to provide a seal and/or to provide a means for distributing the force of the tightened bolt and locking the bolt in the tightened condition. In cases where the washer is used to provide a seal, soft washers, such as aluminum washers which may be coated with paper, are frequently used. During the use of paper coated aluminum washers on bolts, the aluminum and paper tend to extrude, locking the washer onto the bolt head and adjacent thread.

One particular application of such washers is in retaining and sealing automotive automatic transmission covers. During disassembly of a transmission incorporating the bolt-sealing washer combination, the washer typically sticks to the bolt, and is frequently very difficult to remove. Because of the number of such bolts involved, excessive time and, concomitantly, money is lost trying to remove washers from such bolts. Frequently, though undesirable, the old washer is left on during reassembly of the transmission, with a new washer simply being put on over the old washer to effect a new seal. However, this clearly reduces the effectiveness of the washer as a sealing device. The high cost of the bolts probably precludes their disposal upon disassembly, and as a matter of course replacement washers but not replacement bolts are provided in the commercially available overhaul kits, thereby making the successful removal of the used washers highly desirable. The normal and customary techniques for the removal of the washers involve (i) use of a knife or other sharp instrument to separate the washer from the bolt head, (ii) use of a screwdriver to try to separate the washer from the bolt, or (iii) the use of pliers (typically diagonal cutting pliers) to attempt to grab the washer and remove it from the bolt. All of these methods are inefficient, time consuming, frustrating and potentially dangerous to the rebuilder.

SUMMARY OF THE INVENTION

In the present invention, a device is provided which can be used to remove washers from bolts in an efficient, fast and safe manner. The device is comprised of a removable blade assembly disposed in a handle device. The blade assembly has an opening permitting the insertion of the bolt such that when the bolt is fully inserted into the blade assembly, the washer is in contact with a plurality of substantially radially disposed blades. The device itself is provided with a handle, in one embodiment knurled, so that it may be held in a persons hand. After the bolt is inserted into the device, the bolt head is tapped using a striking device, such as a hammer. The force of the impact causes the blades to be driven into the washer, splitting the washer into several arc-shaped pieces and separating them from the bolt. The resulting pieces fall away from the bolt when the bolt is removed from the device, or at least then may be very easily removed from the bolt.

DETAILED DESCRIPTION OF THE INVENTION

Figure 1:
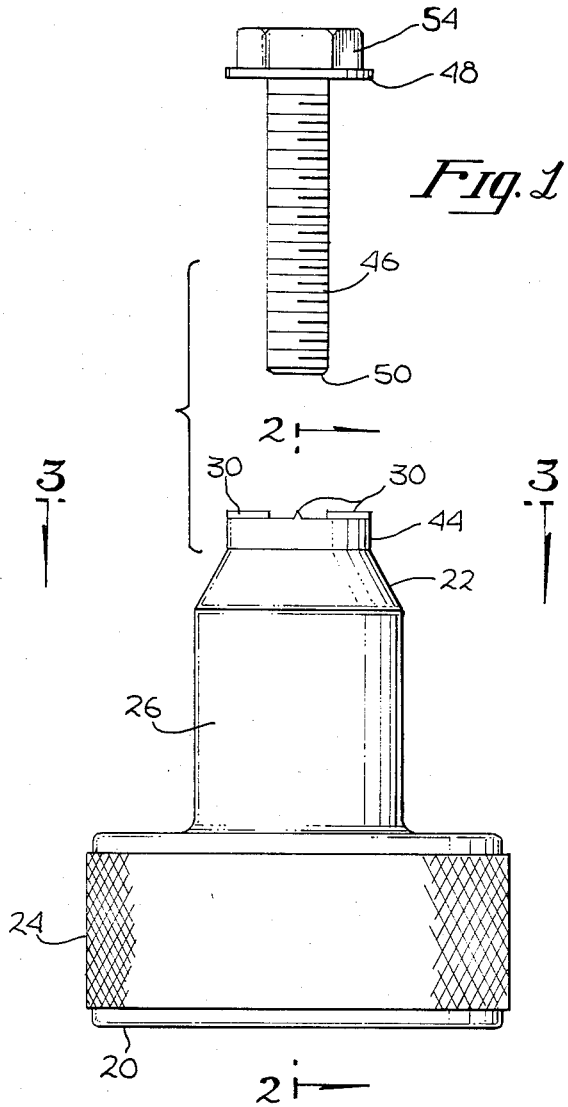
FIG. 1 is a side view of the present invention together with a bolt with a washer thereon in proper orientation for insertion into the device.
Figure 2:
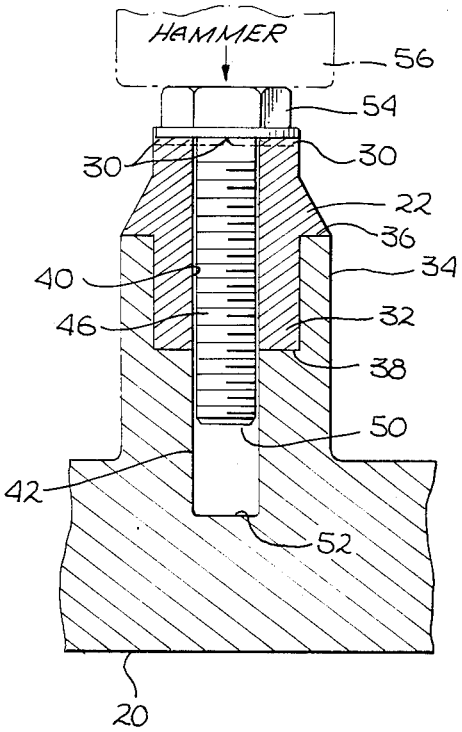
FIG. 2 is a partial cross sectional view of the device taken along line 2—2 of FIG. 1 with a bolt and attached washer shown inserted into the device.

A side view of the present invention washer cutter, together with a bolt with a washer thereon, in proper orientation for use, may be seen in FIG. 1. The assembly shown is comprised of two generally cylindrical parts, specifically, a handle 20, and a blade structure 22. These two elements may also be seen in FIG. 2, which is a partial cross sectional view taken along line 2—2 of FIG. 1. As shown in these figures, the handle 20 in the preferred embodiment is comprised of two regions, the first region being a large diameter (2 to 4 inches) region, generally indicated by the numeral 24, and the second region being a small diameter (0.5 to 1.5 inches) region, generally indicated by the numeral 26. In the preferred embodiment of this invention, the large diameter region 24 is knurled for ease of gripping. The smaller size of the small diameter region 26 is also intended to assist gripping by permitting the ends of the holder's fingers to wrap around the large diameter region 24 and along the length of small diameter region 26. In alternate embodiments to this invention, the handle 20 is mounted on a table or held in a vise or other clamping device, and handle 20 being configured accordingly.

The blade structure 22 has disposed upon its outward facing surface a plurality of radially oriented integral blades 30. In the preferred embodiment of this invention, blade structure 22 is separately fabricated from handle 20 and is cooperatively interfitted with handle 20 such that a lower extension 32 of blade structure 22 is contained within, and supported by, surrounding lip 34 of handle 20, so that an impact force upon blades 30 will result in an opposing force on blade structure 22 to occur along the upper mating surface 36 or the lower mating surface 38. The advantage of the two part construction is that it permits the heat treatment of blade structure 22, which in the preferred embodiment is made of hardenable steel or other hardenable alloy, and in particular blades 30, to a high hardness, independently of the handle 20, which has a relatively large size and mass, and may be fabricated from more readily machinable and lower cost alloys. The handle 20, in the preferred embodiment is made of steel or other similar alloy, which need not be hardenable, and which may remain in the annealed or half hard condition in which it was machined.

Blade structure 22 contains an axially located hole 40 running the entire length of blade structure 22. Handle 20 similarly has an axially located internal hole 42, such that the internal hole 42 runs from the upper surface of the handle 20 and terminates within handle 20. Internal hole 42 is an extension of hole 40, and is coaxial to and of a diameter at least as great as, hole 40. Extension 32 and lip 34 provide lateral support to insure continuity of hole 40 and internal hole 42.

Figure 3:
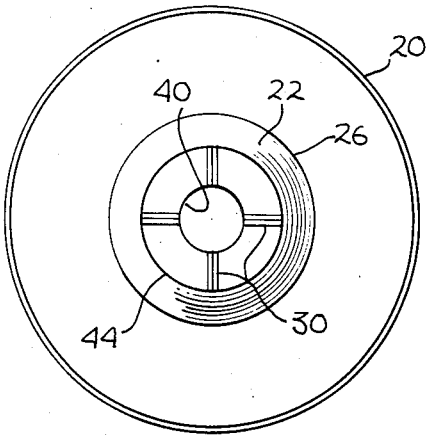
FIG. 3 is an end view of the device of FIG. 1 taken along line 3—3 of FIG. 1.

As is illustrated in FIG. 3, which is an end view of this embodiment of the present invention taken along line 3—3 of FIG. 1, blades 30 are radially distributed around hole 40 on the face of blade structure 22, and have their inner terminations at the periphery of hole 40, and their outer terminations at the outside diameter of the uppermost region 44 of blade structure 22. In the preferred embodiment, at least three blades are used so as to define a plane perpendicular to the axis of the hole 40, as well as to improve the function of this embodiment of the present invention, as will be discussed herein.

In use, a bolt 46 onto which is affixed a washer 48, is inserted into hole 40 such that washer 40 is in contact with blades 30. When the bolt 46 is fully inserted into the hole 40 and internal hole 42, the bolt end 50 is separated from the lower end 52 of internal hole 42 by a distance of not less than the thickness of washer 46, and preferably by a substantially larger distance. In that regard a through-hole could be used, though is not preferred for safety reasons.

The diameter of hole 40 is sufficient to allow the insertion of bolt 46, but at least in the region of the blades is no larger than is necessary for the easy insertion of bolt 46, as it is necessary for the blades 30 to contact as much of the washer 46 width as practical. In that regard, the outside diameter of region 44, and concomitantly the diameter of the circle defined by the outer terminations of blades 30, is at least as large as the outer diameter of washer 48.

After the bolt 46 with affixed washer 48 is inserted into hole 40 (as previously discussed), the washer cutter device is held in one's hand by handle 20. The head 54 of bolt 46 is struck with a striking device 56, typically is a hammer. The mass of handle 20 is sufficiently large that the energy input resulting from the impact may be conveniently dissipated while holding this embodiment of the present invention in one's hand.

During the impact of striking device 56 to head 54 of bolt 46, the washer 48 will be driven onto blades 30 such that the blades 30 will plastically deform washer 48 and finally either split washer 48 into a plurality of pie-shaped pieces which will readily separate from bolt 46, or at least deform washer 48 such that the washer 48 expands and buckles or otherwise separates from bolt 46. In either event, the resulting pieces of washer 48 may be readily removed from bolt 46. As previously noted, in the preferred embodiment of this device, there are at least three blades 30, for the reason that wedge-shaped pieces are more readily removed after operation of the present invention.

There has been disclosed and described herein a new and unique washer cutter device for removing washers which have become affixed to bolts. The preferred embodiment is in two readily machined pieces, of which one is made of hardenable steel, while the other, larger piece, may be of steel or other similar alloy which need not be hardenable.

Obviously, while a specific embodiment of the present invention has been disclosed and described in detail, it will be understood by those skilled in the art that various changes and form and detail may be made thereon without departing from the spirit and scope of the invention.

I claim:

1. A device for the removal of washers affixed to shafts of bolts comprising:

a handle for holding the device and supporting said bolts, said handle comprising a small diameter region at one end of said handle for supporting said bolts and a large diameter region at the other end of said handle for holding said device during operation;

a blade assembly with an outside diameter at least as large as the outside diameter of the washer; and with an axially located opening for the insertion of said shaft of the bolt, said opening having a diameter of slightly larger than the outside diameter of the shaft of the bolt whereby the shaft of the bolt may be readily inserted into said opening;

at least three substantially radially distributed blades on the surface of said blade assembly and extending from the diameter of said opening to at least the outer diameter of the washer, whereby the blades will be in contact with the washer for at least a substantial portion of the radial extent of the washer when the bolt bearing the washer is fully inserted in said opening; and a coupling means for coupling said small diameter region of said handle to said blade assembly, whereby when the head of bolt bearing a washer inserted in said device is struck with a striking means, said blades plastically deform the washer so that the washer is readily separated from the bolt, said large diameter region of said handle dissipating energy generated by said striking means.

2. The device of claim 1 wherein said handle is knurled and of a size to be held in the user's hand.

3. The device of claim 1 wherein said blade assembly is a hardened alloy.

4. The device of claim 1 wherein said coupling means is a recess in said handle into which a mating portion of said blade assembly may be inserted.

5. The device of claim 1 wherein said blade assembly comprises four of said blades.

6. A device for the removal of washers affixed to shafts of bolts comprising:

a handle for holding the device and supporting said bolts, said handle comprising a small diameter region at one end of said handle for supporting said bolt and a large diameter region for holding said device during operation, said large diameter region being knurled and of a size to be held in a user's hand;

a blade assembly removably coupled by coupling means to said small diameter region of said handle, said blade assembly having an outside diameter at least as large as the outside diameter of the washer to be removed; and an axially located opening for the insertion of the shaft of the bolt, said opening having a diameter slightly larger than the outside diameter than the shaft of the bolt, whereby the shaft of the bolt may be readily inserted into said opening; and at least three substantially radially distributed blades on the surface of said blade assembly and extending from the diameter of said opening to at least the outer diameter of the washer, whereby said blades are in contact with the washer for a substantial portion of the width of the washer when the bolt bearing the washer is fully inserted in said opening.

7. The device of claim 6 wherein said blade assembly is a hardened alloy.

8. The device of claim 6 wherein said blade assembly comprises four of said blades.

* * * * *

UNITED STATES PATENT AND TRADEMARK OFFICE

CERTIFICATE OF CORRECTION

PATENT NO. : 4,627,166

DATED : December 9, 1986

INVENTOR(S) : McMinn

It is certified that error appears in the above-identified patent and that said Letters Patent is hereby corrected as shown below:

| COLUMN | LINE | DESCRIPTION |
|---|---|---|
| 4 | 42 | Between the words "region" and "for" please insert --at the other end of said handle--. |

Signed and Sealed this

Fourteenth Day of April, 1987

*Attest:*

DONALD J. QUIGG

*Attesting Officer*

*Commissioner of Patents and Trademarks*